US008544986B2

(12) United States Patent
Tanaka et al.

(10) Patent No.: US 8,544,986 B2
(45) Date of Patent: Oct. 1, 2013

(54) IMAGE FORMING APPARATUS

(75) Inventors: Yuji Tanaka, Kanagawa (JP); Yoichi Ito, Tokyo (JP); Mitsuya Matsubara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/224,436

(22) Filed: Sep. 2, 2011

(65) Prior Publication Data

US 2012/0062648 A1 Mar. 15, 2012

(30) Foreign Application Priority Data

Sep. 11, 2010 (JP) ..... 2010-203804
Sep. 11, 2010 (JP) ..... 2010-203807

(51) Int. Cl.
*B41J 23/00* (2006.01)

(52) U.S. Cl.
USPC ..... 347/37; 347/38; 347/39; 347/86

(58) Field of Classification Search
USPC ..... 347/37, 38, 39, 8, 19, 86; 400/354, 400/352; 384/129
See application file for complete search history.

(56) References Cited

U.S. PATENT DOCUMENTS 4,772,899 A * 9/1988 Mamiya et al. ..... 346/139 R
5,610,636 A * 3/1997 Hanabusa et al. ..... 347/8
6,524,021 B2 * 2/2003 Johnson et al. ..... 400/354
7,695,100 B2 * 4/2010 Matsuyama et al. ..... 347/37
7,753,480 B2 * 7/2010 Ueda et al. ..... 347/37
2004/0091298 A1 * 5/2004 Nellen ..... 400/354
2007/0229572 A1 * 10/2007 Nishida ..... 347/19
2007/0229590 A1 * 10/2007 Kadota et al. ..... 347/37
2010/0283813 A1 * 11/2010 Warnes ..... 347/19
2011/0141181 A1 6/2011 Ito et al.

FOREIGN PATENT DOCUMENTS

JP 2002-137481 5/2002
JP 2005-35032 2/2005
JP 3745747 12/2005
JP 2006-96028 4/2006
JP 3858998 9/2006
JP 2007-144776 6/2007
JP 2007-160532 6/2007

* cited by examiner

*Primary Examiner* — Henok Legesse
(74) *Attorney, Agent, or Firm* — Cooper & Dunham LLP

(57) ABSTRACT

An image forming apparatus including: a carriage movable in a main scanning direction and including a recording head having a nozzle surface in which nozzles to eject liquid droplets in a horizontal direction are formed, the nozzle surface being disposed in a vertical direction; a guide shaft to guide the carriage in the main scanning direction; and a bearing provided to the carriage and having two sloped sides slidably contacting an outer circumferential surface of the guide shaft. In a plane perpendicular to an axis of the guide shaft, the two sloped sides are disposed such that a line passing through both the axis of the guide shaft and an intersection of two tangent lines from contact portions in which the two sloped sides contact the outer circumferential surface of the guide shaft diagonally intersects a line extending along a plane of the nozzle surface.

18 Claims, 14 Drawing Sheets

IMAGE FORMING APPARATUS

CROSS-REFERENCE TO RELATED APPLICATIONS

This patent specification is based on Japanese Patent Application Nos. 2010-203807 and 2010-203804, both filed on Sep. 11, 2010, each of which is hereby incorporated herein by reference in its entirety.

BACKGROUND

1. Technical Field

This disclosure relates generally to an image forming apparatus including a recording head that ejects liquid droplets to form an image.

2. Description of the Background

One example of related-art image forming apparatuses such as printers, copiers, plotters, facsimile machines, and multifunction devices having two or more of printing, copying, plotting, and facsimile functions is an inkjet recording device employing a liquid ejection recording method. The inkjet recording device includes a recording head constituted of a liquid ejection head that ejects droplets of a recording liquid such as ink onto a sheet of recording media while the sheet is conveyed to form an image on the sheet. In a serial-type image forming apparatus, the recording head mounted on a carriage ejects ink droplets while the carriage is moving in a main scanning direction along a guide shaft to form an image on a sheet as the sheet is moved in a sub-scanning direction perpendicular to the main scanning direction.

Stable scanning movement of the carriage is essential for the serial-type image forming apparatus to improve accuracy in landing positions of ink droplets on the recording medium. In order to achieve stable scanning movement of the carriage, a traction position of the carriage to pull the carriage is set based on a weight, center of gravity, and sliding position of the carriage. There is known a serial-type image forming apparatus using bearings provided to the carriage. Each of the bearings has two sloped sides that contact the guide shaft and are arranged in an inverted V-shape relative to the long axis of the guide shaft, such that the guide shaft is stabilized by each of the bearings at two points, that is, the sloped sides. In one example of the above-described serial-type image forming apparatus, the sloped sides are angled to the vertical such that a force that prevents floating of the bearings from the guide shaft is greater than a force that causes the bearings to float during acceleration and deceleration of the carriage.

There is also known a serial-type image forming apparatus in which a head tank is installed on the carriage so that ink is supplied to the head tank from a main tank detachably attachable to the image forming apparatus through a supply tube. Although the supply tube generally extends along a direction of conveyance of the recording medium, sometimes it extends in a direction perpendicular to the direction of conveyance of the recording medium.

With regard to the liquid ejection recording method, there is a horizontal ejection method in which the recording medium is conveyed in a vertical direction or a direction slanted from the vertical direction and the recording head ejects ink droplets in a horizontal direction or a direction slanted from the horizontal direction to the sheet while moving reciprocally back and forth so as to form an image on the sheet. Specifically, in the image forming apparatus employing the horizontal ejection method, a nozzle surface of the recording head in which nozzles that eject ink droplets are formed is disposed vertically or at a slant from the vertical direction, and the recording head ejects the ink droplets horizontally or at a slant from the horizontal direction. Herein, the term "horizontal" includes an angular range up to 45° with respect to the horizontal, and the term "vertical" includes an angular range up to 45° from the vertical. It is to be noted that, in an image forming apparatus employing a vertical ejection method, the recording medium is conveyed in a horizontal direction or a direction slanted from the horizontal direction, and the recording head ejects ink droplets in a vertical direction or a direction slanted from the vertical direction to the sheet.

Because the nozzle surface of the recording head is disposed horizontally in the vertical ejection method, occurrence of yawing that swings the carriage in a horizontal plane during scanning of the carriage displaces the landing positions of the ink droplets on the recording medium. Appropriate setting of the angle of the two sloped sides in each of the bearings relative to the vertical direction can effectively reduce occurrence of yawing in the carriage.

By contrast, because the nozzle surface of the recording head is disposed vertically in the horizontal ejection method, occurrence of pitching that swings the carriage in a vertical plane during scanning of the carriage displaces the landing positions of the ink droplets on the recording medium. Similar to the vertical ejection method, pitching movement that swings the carriage in the vertical plane is increased in the horizontal ejection method when the two sloped sides in each of the bearings sandwich the guide shaft from the vertical direction. In addition, occurrence of pitching in the carriage cannot be reduced in the horizontal ejection method by simply changing an orientation of each of the two sloped sides to the horizontal direction in conformity with a change in an orientation of the nozzle surface from the horizontal direction to the vertical direction.

SUMMARY

This disclosure provides a novel image forming apparatus that prevents pitching of a carriage during a horizontal ejection, thereby improving image quality, while also eliminating the effects of movement of the carriage due to restorative force of a supply tube.

In one illustrative embodiment, an image forming apparatus includes: a carriage movable in a main scanning direction and including a recording head having a nozzle surface in which nozzles to eject liquid droplets in a horizontal direction or a direction slanted from the horizontal direction are formed, the nozzle surface being disposed in a vertical direction or a direction slanted from the vertical direction; a guide shaft to guide the carriage in the main scanning direction; and a bearing provided to the carriage, the bearing having two sloped sides each slidably contacting an outer circumferential surface of the guide shaft. In a plane perpendicular to an axis of the guide shaft, the two sloped sides in the bearing are disposed such that a line passing through both the axis of the guide shaft and an intersection of two tangent lines from contact portions on the outer circumferential surface of the guide shaft in which the two sloped sides contact the outer circumferential surface of the guide shaft diagonally intersects a line extending along a plane of the nozzle surface.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF ILLUSTRATIVE EMBODIMENTS

Figure 1:
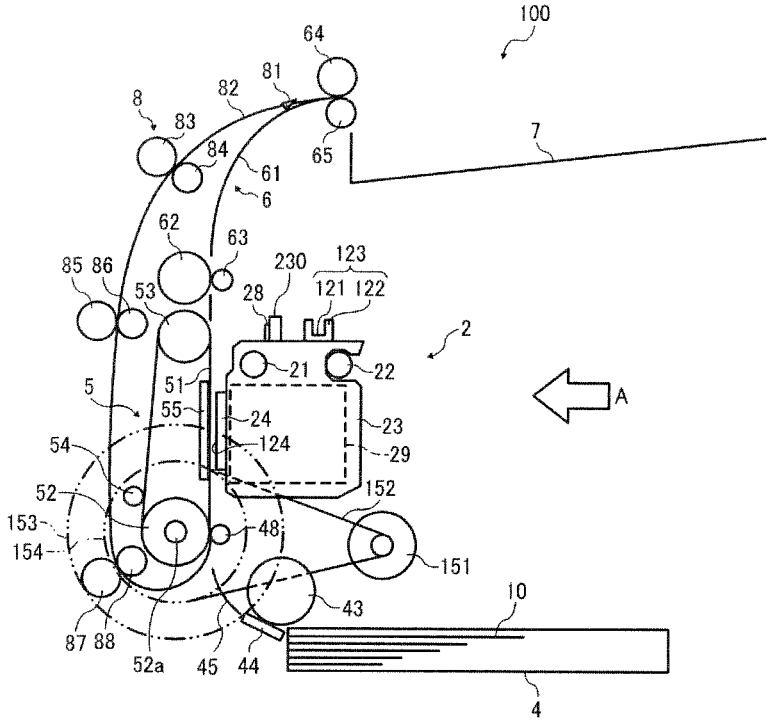
FIG. 1 is a vertical cross-sectional view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Image forming apparatuses hereinafter described form an image on a recording medium, such as paper, string, fiber, cloth, lather, metal, plastics, glass, wood, and ceramics by ejecting ink droplets onto the recording medium. In this specification, an image refers to both signifying images such as characters and figures, as well as a non-signifying image such as patterns. In addition, ink includes any material which is a liquid when ejected from the recording head, such as a DNA sample, a resist material, and a pattern material. A sheet is not limited to a sheet of paper, but also includes any material onto which ink droplets adhere, such as an OHP sheet and the examples of the recording medium described above. Further, an image formed on the recording medium is not limited to a flat image, but also includes an image formed on a three-dimensional object, a three-dimensional image, and so forth.

Figure 2:
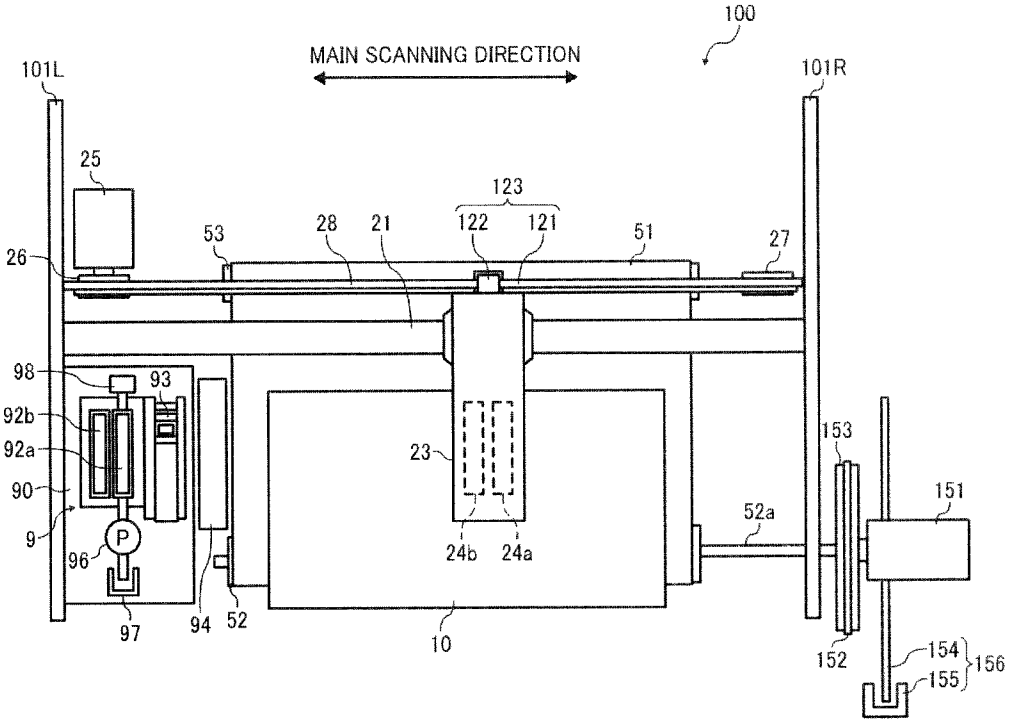
FIG. 2 is a schematic view illustrating the configuration of the image forming apparatus viewed from a direction indicated by arrow A in FIG. 1.

A description is now given of a configuration and operation of a serial-type image forming apparatus 100 according to illustrative embodiments, with reference to FIGS. 1 and 2. FIG. 1 is a vertical cross-sectional view illustrating an example of a configuration of the image forming apparatus 100. FIG. 2 is a schematic view illustrating the configuration of the image forming apparatus 100 viewed from a direction indicated by arrow A in FIG. 1.

The image forming apparatus 100 includes an image forming unit 2, a conveyance mechanism 5, a sheet feed tray 4 provided in a lower part thereof to store a sheet 10 serving as a recording medium, and so forth. The image forming unit 2 ejects ink droplets in a horizontal direction (or a direction along the horizontal direction) to the sheet 10 to form an image on the sheet 10 while the sheet 10 fed from the sheet feed tray 4 is intermittently conveyed upward in a vertical direction (or a direction along the vertical direction) by the conveyance mechanism 5. The sheet 10 bearing the image thereon is then further conveyed upward through a discharge unit 6 to be discharged to a discharge tray 7 provided in an upper part of the image forming apparatus 100.

During duplex printing, after the image is formed on a front side of the sheet 10, the sheet 10 is conveyed from the discharge unit 6 to a reversal unit 8. Subsequently, the sheet 10 is conveyed downward by the conveyance mechanism 5 and is reversed such that an image is formed on a back side of the sheet 10 by the image forming unit 2. After the image is formed on the back side of the sheet 10, the sheet 10 is discharged to the discharge tray 7.

In the image forming unit 2, a carriage 23 in which recording heads 24*a* and 24*b* (hereinafter collectively referred to as recording heads 24) are installed is slidably held by a main guide member 21 serving as a guide shaft and a sub-guide member 22, each extended between right and left lateral plates 101R and 101L. The carriage 23 is moved reciprocally back and forth in a main scanning direction by a main scanning motor 25 via a timing belt 28 wound around a drive pulley 26 and a driven pulley 27.

Each of the recording heads 24 is constituted of a liquid ejection head that ejects ink droplets of a specific color, that is, yellow (Y), magenta (M), cyan (C), or black (K), and has a nozzle surface 124. As described in detail later with reference to FIG. 3, in the nozzle surface 124, nozzle arrays Na and Nb each constituted of multiple nozzles 124*b* to eject the ink droplets are arranged in a sub-scanning direction perpendicular to the main scanning direction. The recording heads 24 are installed such that the ink droplets are ejected in a horizontal direction. In other words, the image forming apparatus 100 employs a horizontal ejection method in which the nozzle surface 124 of each of the recording heads 24 is disposed vertically so as to eject the ink droplets horizontally.

Figure 3:
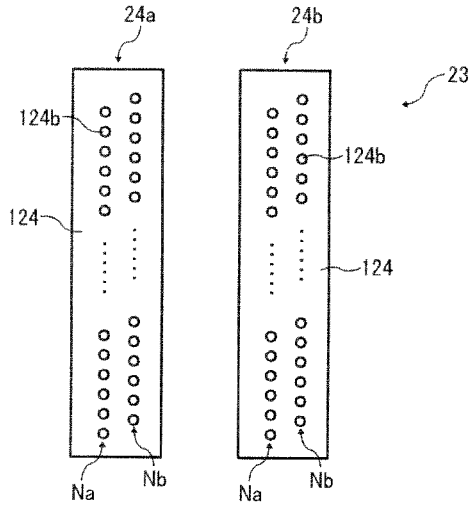
FIG. 3 is a schematic view illustrating an example of a configuration of recording heads employed in the image forming apparatus.

FIG. 3 is a schematic view illustrating an example of a configuration of the recording heads 24. Each of the recording heads 24 has the nozzle surface 124 in which the nozzle arrays Na and Nb each constituted of the multiple nozzles 124*b* are formed. Yellow liquid droplets are ejected from the nozzle array Na of the recording head 24*a* and magenta liquid droplets are ejected from the nozzle array Nb of the recording head 24*a*. Black liquid droplets are ejected from the nozzle array Na of the recording head 24*b* and cyan liquid droplets are ejected from the nozzle array Nb of the recording head 24*b*.

The liquid ejection head constituting each of the recording heads 24 may include a pressure generator to generate a pressure for ejecting the ink droplets. The pressure generator may, for example, be a piezoelectric actuator having a piezoelectric element, a thermal actuator using an electrothermal converter such as a heat-generating resistor to use a phase change caused by film boiling of a liquid, a memory metal actuator using a metallic phase change caused by a temperature change, or an electrostatic actuator using an electrostatic force. It is to be noted that a dedicated liquid ejection head that ejects a fixer to improve fixing property of ink by reacting with the ink may also be installed in the carriage 23.

Returning to FIG. 1, the carriage 23 further includes a head tank 29 that supplies ink of the specified color to the corresponding nozzle array Na or Nb in each of the recording heads 24. Ink is supplied to the head tank 29 from main tanks 11 detachably attachable to the image forming apparatus 100. A detailed description of the main tanks 11 is given later in this specification with reference to FIG. 19.

An encoder scale 121 having a predetermined pattern thereon is extended between the right and left lateral plates 101R and 101L in the main scanning direction of the carriage 23. An encoder sensor 122 including a transmissive photosensor that reads the pattern of the encoder scale 121 is provided to the carriage 23. The encoder scale 121 and the encoder sensor 122 together constitute a linear encoder (main scanning encoder) 123 that detects movement of the carriage 23.

As shown in FIG. 2, a servicing mechanism 9 that services the nozzles 124*b* in the recording heads 24 is provided to a frame 90 outside the imaging range of the image forming apparatus 100 in the main scanning direction. The servicing mechanism 9 includes a suction cap 92*a* and a cap 92*b* that cap the nozzle surfaces 124 of the recording heads 24, respectively, a wiper 93 that wipes off the nozzle surfaces 124, and a receiver 94 that receives ink droplets not used for image formation and preliminarily ejected from the recording heads 24 for maintenance to remove coagulated ink from the recording heads 24. The suction cap 92*a* is connected to a suction pump 96 serving as a suction member connected to a waste tank 97. The suction cap 92*a* is provided with a closely openable release valve 98 that releases a sealed space formed within the suction cap 92*a* when the nozzle surface 124 of the recording head 24*a* or 24*b* is capped with the suction cap 92*a*.

The sheet 10 stored in the sheet feed tray 4 is fed one by one by a sheet feed roller 43 and a separation pad 44 and is conveyed along a guide member 45 to a portion between an endless conveyance belt 51 and a pressing roller 48, each included in the conveyance mechanism 5. The sheet 10 attracted to the conveyance belt 51 is then conveyed by the conveyance belt 51.

The conveyance belt 51 is wound around a conveyance roller 52 serving as a drive roller and a driven roller 53. The conveyance mechanism 5 further includes a charging roller 54 that charges the conveyance belt 51 and a platen member 55 that provides flatness to the conveyance belt 51 at a portion opposite the image forming unit 2.

The conveyance belt 51 is rotated in the sub-scanning direction, that is, a direction of conveyance of the sheet 10, by the conveyance roller 52 rotated by a sub-scanning motor 151 via a timing belt 152 and a timing pulley 153.

The conveyance mechanism 5 further include a cord wheel 154 attached to a shaft 52*a* of the conveyance roller 52 and an encoder sensor 155 including a transmissive photosensor that detects a pattern formed in the cord wheel 154. The cord wheel 154 and the encoder sensor 155 together constitute a rotary encoder (sub-scanning encoder) 156 that detects an amount of movement and a position of the conveyance belt 51.

The discharge unit 6 includes a discharge guide member 61, a discharge conveyance roller 62, a first spur 63, a discharge roller 64, and a second spur 65. The sheet 10 having the image thereon is discharged between the discharge roller 64 and the second spur 65 to the discharge tray 7, with the side having the image thereon facing down.

The reversal unit 8 includes a changeover pick 81 that switches a direction of conveyance of the sheet 10 between a discharge path including the discharge guide member 61 and a reversal path 82. Specifically, the changeover pick 81 reverses the direction of conveyance of the sheet 10, a part of which is discharged to the discharge tray 7, using a switchback system so that the sheet 10 is conveyed backward between the conveyance belt 51 and the pressing roller 48. In the reversal path 82, a reversal roller 83, a third spur 84, a conveyance roller 85, a fourth spur 86, a conveyance roller 87, and a fifth spur 88 are provided.

In the image forming apparatus 100 having the above-described configuration, the sheet 10 fed one by one from the sheet feed tray 4 is electrostatically attracted to the charged conveyance belt 51, and is vertically conveyed upward by the rotation of the conveyance belt 51. The recording heads 24 are driven based on an image signal while the carriage 23 is moved so that ink droplets are ejected from the recording heads 24 to the sheet 10, which remains stationary, so as to form a single line in an image to be formed on the sheet 10. Thereafter, the sheet 10 is moved by a predetermined amount to perform image formation of the next line. Upon completion of image formation, the sheet 10 having the image thereon is discharged to the discharge tray 7.

During servicing of the nozzles 124*b* of the recording heads 24, the carriage 23 is moved to a home position opposite the servicing mechanism 9. The nozzle surface 124 of the recording head 24*a* is capped with the suction cap 92*a* so that coagulated ink is sucked out and ink droplets not used for image formation are ejected from the nozzles 124*b* for maintenance, thereby achieving optimal ejection of ink droplets to form higher-quality images. When servicing the nozzles 124*b* of the recording head 24*b*, the carriage 23 is moved in the main scanning direction such that the nozzle surface 124 of the recording head 24*b* is positioned opposite the suction cap 92*a*. The suction cap 92*a* caps the nozzle surface 124 of the recording head 24*b* to suck out coagulated ink from the nozzles 124*b*.

During duplex image formation, after the image is formed on the front side of the sheet 10 with the processes described above, the discharge roller 64 is reversely driven when a trailing edge of the sheet 10 passes the changeover pick 81. As a result, the sheet 10 is guided backward to the reversal path 82 and is further conveyed by the reversal roller 83, the third spur 84, the conveyance roller 85, the fourth spur 86, the conveyance roller 87, and the fifth spur 88 to the portion between the conveyance belt 51 and the pressing roller 48. Thus, the sheet 10 is attracted to the conveyance belt 51 and is conveyed by the rotation of the conveyance belt 51 to the imaging range. After an image is formed on the back side of the sheet 10 by the recording heads 24, the sheet 10 is discharged to the discharge tray 7.

Figure 4:
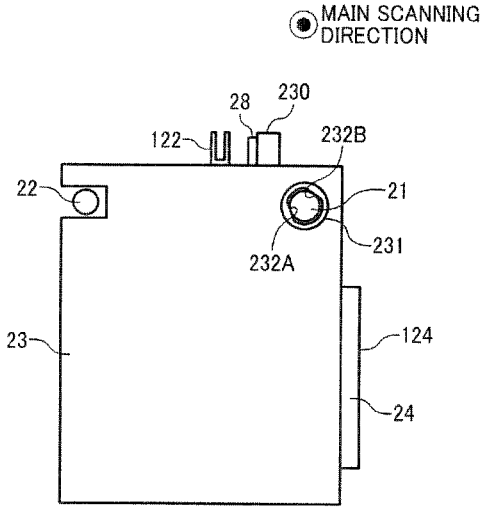
FIG. 4 is a side view illustrating a configuration of a carriage employed in the image forming apparatus.
Figure 5:
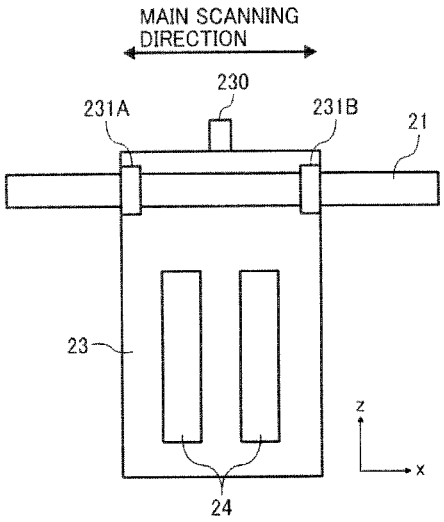
FIG. 5 is a front view illustrating the configuration of the carriage illustrated in FIG. 4.

A description is now given of a configuration of a support structure for the carriage 23 in the image forming apparatus 100, with reference to FIGS. 4 and 5. FIG. 4 is a side view illustrating a configuration of the carriage 23. FIG. 5 is a front view illustrating the configuration of the carriage 23 illustrated in FIG. 4.

As described above, the carriage 23 is slidably held in the main scanning direction by the main guide member 21 and the sub-guide member 22, and is moved by the timing belt 28 and a transmission part 230. Both the timing belt 28 and the transmission part 230 are included in a carriage scanning mechanism, and are coupled to the carriage 23. Two bearings 231A and 231B (hereinafter collectively referred to as bearings 231) into which the main guide member 21 is inserted are provided to both lateral ends of the carriage 23 in the main scanning direction, respectively.

The recording heads 24 are installed on the carriage 23 such that the nozzle surfaces 124 face vertically to eject ink droplets horizontally.

A sliding position of each of the bearings 231 against the main guide member 21 and a traction position of the carriage 23, that is, the transmission part 230, may be disposed at the same position as the center of gravity of the carriage 23 so as to cause a torque applied to the carriage 23 to approach zero. However, in actuality, because the head tank 29 that supplies ink to the recording heads 24 is also installed on the carriage 23, it is difficult to dispose the sliding position of each of the bearings 231 against the main guide member 21 and the traction position of the carriage 23 at the center of gravity of the carriage 23. Thus, in order to minimize the torque applied to the carriage 23, it is preferable that the sliding position of each of the bearings 231 against the main guide member 21 and the traction position of the carriage 23 be as close as possible to the center of gravity of the carriage 23.

In a case in which the sliding position of each of the bearings 231 against the main guide member 21 is disposed at a position other than the center of gravity of the carriage 23, it is preferable that the main guide member 21 be positioned closer to the recording heads 24 so as to prevent scanning movement of the carriage 23 from adversely affecting the recording heads 24.

As described above, in addition to the main guide member 21, the sub-guide member 22 is further provided so that both the main guide member 21 and the sub-guide member 22 support the carriage 23, thereby achieving stable scanning of the carriage 23. In general, a cylindrical shaft or metal plate is used for the sub-guide member 22.

When the main guide member 21 and the sub-guide member 22 are respectively positioned to sandwich the recording heads 24, sliding load between the sub-guide member 22 and the carriage 23 disturbs stable scanning of the carriage 23. Therefore, it is preferable that the main guide member 21 and the sub-guide member 22 be substantially disposed at the same height.

Further, when the positions of the recording heads 24 detected by the encoder sensor 122 installed on the carriage 23 are different from actual positions of the recording heads 24 due to an impact of the scanning movement of the carriage 23, ink droplets are not accurately ejected onto target landing positions on the sheet 10. Therefore, the encoder sensor 122 is disposed so as to displace in the same direction as the recording heads 24 when the recording heads 24 are displaced due to the impact of the scanning movement of the carriage 23, thereby preventing deterioration in accuracy of the landing positions of the ink droplets.

Figure 6:
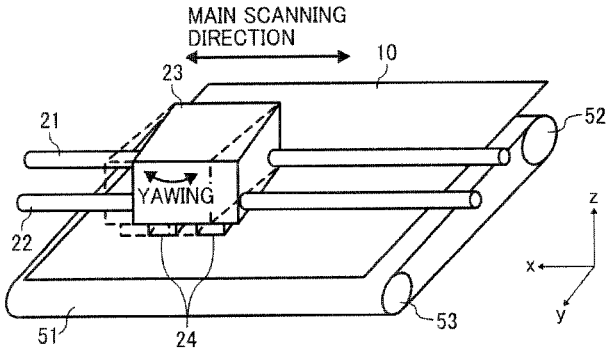
FIG. 6 is a perspective view explaining yawing movement of a carriage in an image forming apparatus employing a vertical ejection method.

A description is now given of yawing of the carriage included in the image forming apparatus employing the vertical ejection method, with reference to FIG. 6. FIG. 6 is a perspective view explaining yawing of the carriage 23 included in the image forming apparatus 100 employing the vertical ejection method.

Referring to FIG. 6, in general, rolling that rotates the carriage 23 around the X axis, pitching that rotates the carriage 23 around the Y axis, and yawing that rotates the carriage 23 around the Z axis occur in the serial-type image forming apparatus 100 during acceleration and deceleration of the carriage 23 due to the inertia of the carriage 23.

In the image forming apparatus 100 employing the vertical ejection method, the X axis corresponds to the main scanning direction, the Y axis corresponds to the direction of conveyance of the sheet 10, that is, the sub-scanning direction, and the Z axis corresponds to a direction perpendicular to the direction of conveyance of the sheet 10.

Because the nozzle surfaces 124 of the recording heads 24 are disposed horizontally in the image forming apparatus 100 employing the vertical ejection method, the ink droplets ejected from the nozzles 124*b* positioned apart from the main guide member 21 tend not to land on target landing positions on the sheet 10 due to swinging motion of the recording heads 24 in the main scanning direction on a horizontal plane. In other words, in the vertical ejection method, yawing that rotates the carriage 23 around the Z axis most adversely affects accuracy in the landing positions of the ink droplets. In order to prevent occurrence of yawing in the carriage 23, it is necessary to minimize dimensional tolerances of the main guide member 21 and the bearings 231 of the carriage 23. However, a gap of a certain size is also needed between the main guide member 21 and each of the bearings 231 for smooth sliding movement of the carriage 23 against the main guide member 21. Further, taking into consideration dimensional changes in both the main guide member 21 and the bearings 231 due to temperature change, the gap is required to be as large as possible.

Therefore, even when both the main guide member 21 and the bearings 231 are formed of a material that prevents dimensional changes due to temperature change, a gap of about 50 μm at a maximum (including manufacturing tolerance) is required between the main guide member 21 and each of the bearings 231. Consequently, for example, in the image forming apparatus 100 having a resolution of 600 dpi, the gap may displace the landing positions of the ink droplets on the sheet 10 by not less than 1 pixel.

It is known that load from a supply tube 301, described later, connected to the head tank 29 installed on the carriage 23 causes yawing and pitching in the carriage 23. In order to reduce the load from the supply tube 301 that adversely affects the scanning movement of the carriage 23, it is preferable that a connection part that connects the supply tube 301 and the head tank 29 be disposed closer to where the main guide member 21 and each of the bearings 231 contact each other.

Figure 7:
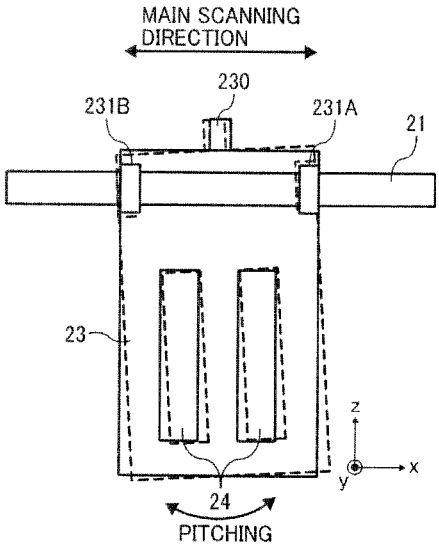
FIG. 7 is a front view explaining pitching movement of a carriage in an image forming apparatus employing a horizontal ejection method.

A description is now given of pitching of the carriage 23 included in the image forming apparatus 100 employing the horizontal ejection method, with reference to FIG. 7. FIG. 7 is a front view explaining pitching of the carriage 23 included in the image forming apparatus 100 employing the horizontal ejection method.

In the horizontal ejection method, the X axis corresponds to the main scanning direction, the Y axis corresponds to the direction perpendicular to the direction of conveyance of the sheet 10, and the Z axis corresponds to the direction of conveyance of the sheet 10, that is, the sub-scanning direction. Because the nozzle surfaces 124 of the recording heads 24 are disposed vertically in the image forming apparatus 100 employing the horizontal ejection method, the ink droplets ejected from the nozzles 124*b* positioned apart from the main guide member 21 tend not to land on target landing positions on the sheet 10 due to swinging motion of the recording heads 24 in the main scanning direction on a vertical plane. In other words, in the horizontal ejection method, pitching that rotates the carriage 23 around the Y axis most adversely affect accuracy in the landing positions of the ink droplets.

Figure 8:
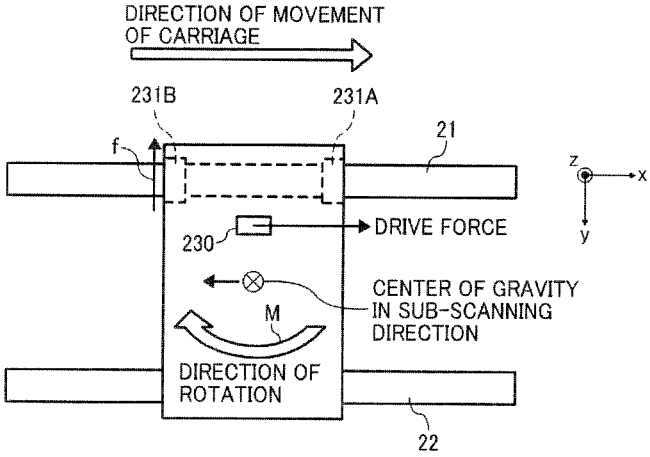
FIG. 8 is a plan view illustrating a configuration of a carriage in an image forming apparatus according to a first illustrative embodiment.
Figure 9:
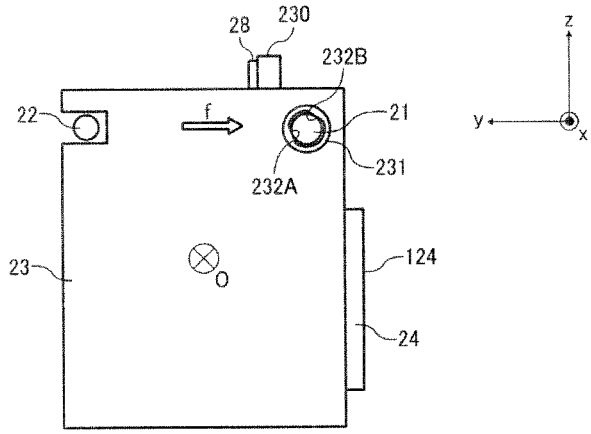
FIG. 9 is a side view illustrating the configuration of the carriage illustrated in FIG. 8.
Figure 10:
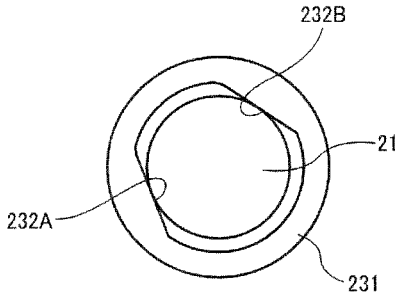
FIG. 10 is an enlarged view illustrating the configuration of the bearing provided to the carriage.
Figure 11:
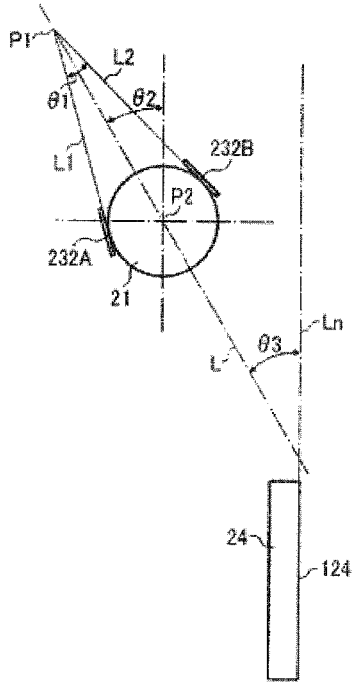
FIG. 11 is a schematic view illustrating relative positions of sloped sides in the bearing and a nozzle surface of the recording head.

A configuration of the bearings 231 provided to the carriage 23 according to a first illustrative embodiment is described in detail below with reference to FIGS. 8 to 11. FIG. 8 is a plan view illustrating the configuration of the carriage 23 according to the first illustrative embodiment. FIG. 9 is a side view illustrating the configuration of the carriage 23 illustrated in FIG. 8. FIG. 10 is an enlarged view illustrating the configuration of the bearing 231 provided to the carriage 23. FIG. 11 is a schematic view illustrating relative positions of sloped sides in the bearing 231 and the nozzle surface 124 of the recording head 24.

In the first illustrative embodiment, as illustrated in FIGS. 8 and 9, the transmission part 230 (or the traction position) of the carriage 23 is positioned between portions of the carriage 23 supported by the main guide member 21 (or simply, the main guide member 21) and the center of gravity O of the carriage 23 in a direction perpendicular to the main scanning direction.

Each of the bearings 231 has two sloped sides 232A and 232B, each slidably contacting an outer circumferential surface of the main guide member 21. As illustrated in FIG. 11, a tangent line L1 from a contact point between the outer circumferential surface of the main guide member 21 and the sloped side 232A and a tangent line L2 from a contact point between the outer circumferential surface of the main guide member 21 and the sloped side 232B intersect each other at an intersection P1. The sloped sides 232A and 232B in each of the bearings 231 are disposed such that a line L passing through both the intersection P1 and the axis P2 of the main guide member 21 intersects a line Ln extending along the plane of the nozzle surfaces 124 of the recording heads 24 at an angle θ3. It is to be noted that the angle θ3 is the same as an angle θ2 in FIG. 11 when the nozzle surfaces 124 are disposed vertically.

An angle θ1 formed between the tangent lines L1 and L2 is hereinafter also referred to as the opened angle θ1 of each of the bearings 231, and the tilt angle θ2 of the line L relative to the nozzle surfaces 124 of the recording heads 24 is hereinafter also referred to as the insertion angle θ2 of each of the bearings 231.

Figure 12:
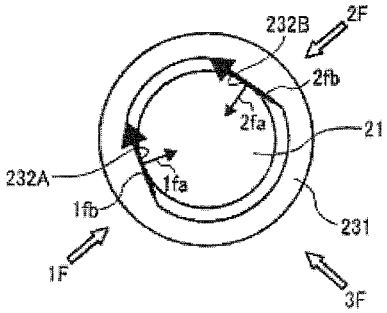
FIG. 12 is a schematic view explaining forces applied to the bearing.
Figure 13:
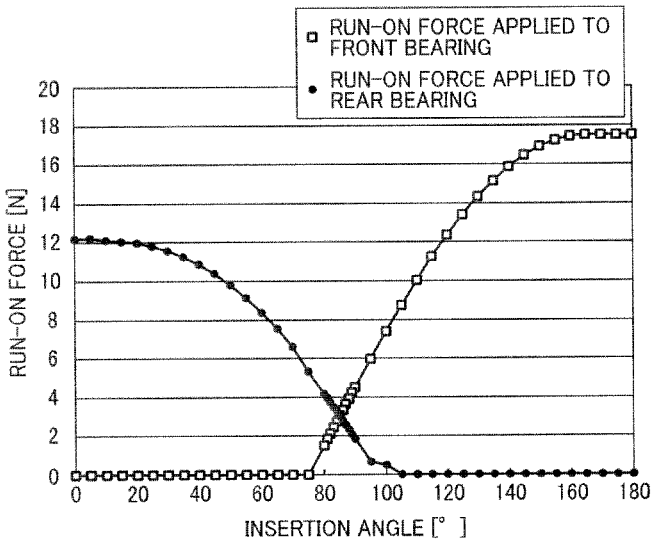
FIG. 13 is a graph showing an example of a relation between an insertion angle of the bearing and a run-on force applied to the bearing.

The above-described configuration reduces occurrence of pitching in the carriage 23 in the image forming apparatus 100 employing the horizontal ejection method, as is described in detail below with reference to FIGS. 12 and 13. FIG. 12 is a schematic view explaining forces applied to each of the bearings 231. FIG. 13 is a graph showing a relation between the insertion angle θ2 of each of the bearings 231 and a run-on force applied to the bearings 231.

As illustrated in FIG. 12, when acting on the bearings 231, external forces 1F and 2F generated by driving of the carriage 23 are respectively divided into forces 1*fa* and 2*fa* vertically applied to the sloped sides 232A and 232B and forces 1*fb* and 2*fb* applied to the sloped sides 232A and 232B in a direction parallel to the sloped sides 232A and 232B. The forces 1*fb* and 2*fb* cause the bearings 231 to run onto the main guide member 21. Thus, the force that causes the bearings 231 to run onto the main guide member 21 (hereinafter referred to as a run-on force) is reduced when the external forces 1F and 2F are received by the sloped sides 232A and 232B in each of the bearings 231.

Ideally speaking, angles of the sloped sides 232A and 232B are set perpendicular to directions of the external forces F1 and F2 so as to prevent generation of the run-on force. However, consequently, sliding load between the bearings 231 and the main guide member 21 is increased. Therefore, the optimum opened angle θ1 formed between the two sloped sides 232A and 232B is determined by taking into consideration the sliding load and the run-on force.

Meanwhile, application of an external force 3F to the sloped sides 232A and 232B from a direction in which the sloped sides 232A and 232B do not receive reactive forces from the main guide member 21 as illustrated in FIG. 12 causes the bearings 231 to float. Consequently, the advantages provided by the presence of the bearings 231, each of which supports at two points, that is, the sloped sides 232A and 232B, cannot be obtained.

Because the nozzle surfaces 124 of the recording heads 24 are disposed horizontally in the vertical ejection method, the insertion angle θ2 is set to 0 degrees so as to prevent occurrence of yawing in the carriage 23, which most adversely affects accuracy in the landing positions of the ink droplets.

By contrast, in the horizontal ejection method, the nozzle surfaces 124 are turned at 90 degrees in comparison to the nozzle surfaces 124 in the vertical ejection method. When simply applying the configuration of the vertical ejection method, the insertion angle θ2 is set to 90 degrees in the horizontal ejection method. However, when the insertion angle θ2 is set to 90 degrees, the sloped sides 232A and 232B do not receive a force acting in the direction of the Y axis. Because occurrence of pitching in the carriage 23 most adversely affect accuracy in the landing positions of the ink droplets in the horizontal ejection method, the insertion angle θ2 is substantially set in a range from 60 degrees to not greater than 90 degrees in the first illustrative embodiment.

Specifically, when the transmission part 230 of the carriage 23 is positioned between the main guide member 21 and the center of gravity O of the carriage 23 in the direction perpendicular to the main scanning direction as illustrated in FIGS. 8 and 9, the run-on force is generated at the sloped side 232B, which is positioned farther from the center of gravity O of the carriage 23 than the sloped side 232A in the vertical direction, in the front bearing 231A in the direction of movement of the carriage 23 during acceleration of the carriage 23.

In addition, the run-on force is generated at the sloped side 232A, which is positioned closer to the center of gravity O of the carriage 23 than the sloped side 232B in the vertical direction, in the rear bearing 231B in the direction of movement of the carriage 23 during acceleration of the carriage 23.

At this time, the run-on force applied to the rear bearing 231B is greater than the run-on force applied to the front bearing 231A. Accordingly, reduction of the run-on force applied to the rear bearing 231B efficiently stabilizes scanning movement of the carriage 23.

In a cross-section of the carriage 23 along an x-y plane that passes through the axis of the main guide member 21, when the transmission part 230 is positioned closer to the main guide member 21 than the center of gravity O of the carriage 23, a torque M generated by the inertia of the carriage 23 is applied to the carriage 23 in a clockwise direction as illustrated in FIG. 8 during acceleration of the carriage 23. The torque M causes occurrence of pitching in the carriage 23, and consequently, a load f is applied to the rear bearing 231B.

Therefore, orientations of the sloped sides 232A and 232B are set in a direction in which the main guide member 21 is dug into the sloped sides 232A and 232B by the load f. As a result, the bearings 231 are prevented from running on the main guide member 21, thereby preventing occurrence of pitching in the carriage 23.

By contrast, during deceleration of the carriage 23, the run-on force is generated at the sloped side 232A, which is positioned closer to the center of gravity O of the carriage 23 than the sloped side 232B in the vertical direction, in the front bearing 231A.

In addition, the run-on force is generated at the sloped side 232B, which is positioned farther from the center of gravity O of the carriage 23 than the sloped side 232A in the vertical direction, in the rear bearing 232B during deceleration of the carriage 23.

At this time, the run-on force applied to the front bearing 231A is greater than the run-on force applied to the rear bearing 231B. Accordingly, reduction of the run-on force applied to the front bearing 231A efficiently stabilizes scanning movement of the carriage 23.

In a cross-section of the carriage 23 along the x-y plane, a torque is generated during deceleration of the carriage 23 in a direction opposite the direction of the torque M generated during acceleration of the carriage 23. Therefore, the orientations of the sloped sides 232A and 232B are set the same as those set during acceleration of the carriage 23 as described above, thereby preventing occurrence of pitching in the carriage 23 during deceleration of the carriage 23.

A description is now given of the insertion angle θ2 with reference to FIG. 13. In the example shown in FIG. 13, the opened angle θ1 is set to 30 degrees.

As shown in FIG. 13, the smaller the insertion angle θ2, the larger the run-on force applied to the rear bearing 232B. The larger the insertion angle θ2, the larger the run-on force applied to the front bearing 232A. It is preferable that the insertion angle θ2 be set so as to minimize the run-on force applied to the bearings 231A and 231B. In the example shown in FIG. 13, the insertion angle θ2 of 83.2 degrees minimizes the run-on force applied to the bearings 231A and 231B, respectively.

Specifically, when the transmission part 230 of the carriage 23 is positioned between the main guide member 21 and the center of gravity O of the carriage 23, in a plane that passes through the axis of the main guide member 21 and is perpendicular to the direction of conveyance of the sheet 10, the intersection P1 of the tangent lines L1 and L2 is positioned on the same side as the center of gravity O of the carriage 23 relative to a vertical line passing through the axis of the main guide member 21 so as to prevent occurrence of pitching in the carriage 23, thereby improving image quality.

Thus, in the plane perpendicular to the axis of the main guide member 21, the sloped sides 232A and 232B are disposed such that the line L that passes through both the intersection P1 of the tangent lines L1 and L2 and the axis P2 of the main guide member 21 diagonally intersects the line Ln extending along the plane of the nozzle surfaces 124 of the recording heads 24 so as to prevent occurrence of pitching in the carriage 23 employing the horizontal ejection method, thereby improving image quality.

Figure 14:
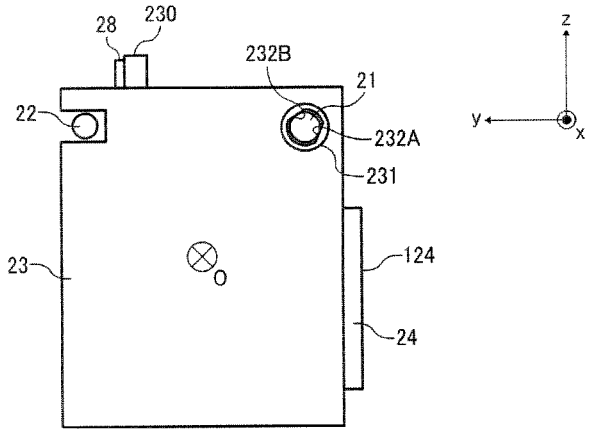
FIG. 14 is a side view illustrating a configuration of a carriage in an image forming apparatus according to a second illustrative embodiment.
Figure 15:
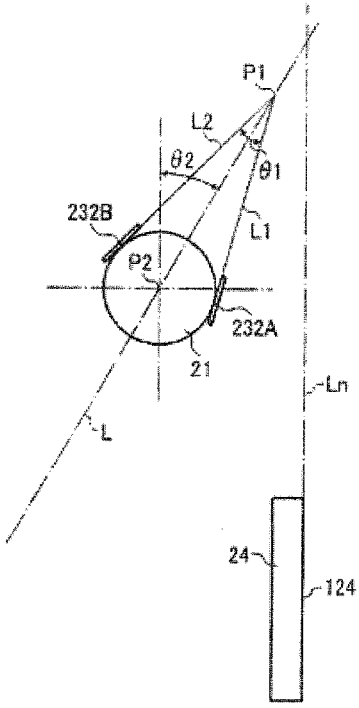
FIG. 15 is a schematic view illustrating relative positions of the sloped sides in each of the bearings and the nozzle surface of the recording head according to the second illustrative embodiment.

A description is now given of a configuration of a support structure that supports the carriage 23 relative to the main guide member 21 in the image forming apparatus 100 according to a second illustrative embodiment, with reference to FIGS. 14 and 15. FIG. 14 is a side view illustrating a configuration of the carriage 23 according to the second illustrative embodiment. FIG. 15 is a schematic view illustrating relative positions of the sloped sides 232A and 232B in each of the bearings 231 and the nozzle surface 124 of the recording head 24 according to the second illustrative embodiment.

In the second illustrative embodiment, as illustrated in FIG. 14, the transmission part 230 of the carriage 23 is positioned on the opposite side from the main guide member 21 with the center of gravity O of the carriage 23 interposed therebetween in a plane perpendicular to the main scanning direction.

In such a case, in the plane that passes through the axis of the main guide member 21 and is perpendicular to the direction of conveyance of the sheet 10, the intersection P1 of the tangent lines L1 and L2 is positioned on the opposite side from the center of gravity O of the carriage 23 relative to the vertical line passing through the axis of the main guide member 21 with the main guide member 21 interposed therebetween as illustrated in FIG. 15.

As a result, occurrence of pitching in the carriage 23 is prevented, thus improving image quality in a manner similar to the first illustrative embodiment.

Figure 16:
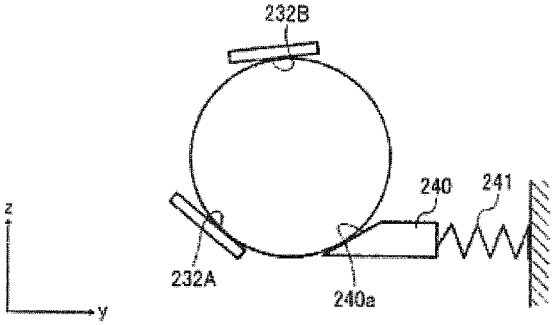
FIG. 16 is a schematic view illustrating a configuration of main components in an image forming apparatus according to a third illustrative embodiment.
Figure 17:
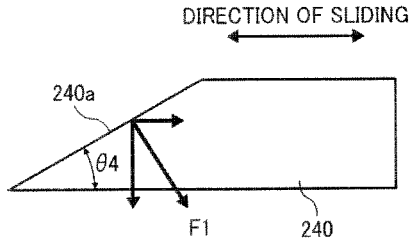
FIG. 17 is an enlarged view illustrating a configuration of a slide member illustrated in FIG. 16.

A description is now given of a third illustrative embodiment of the present invention, with reference to FIGS. 16 and 17. FIG. 16 is a schematic view illustrating a configuration of a slide member 240 provided to the image forming apparatus 100 according to the third illustrative embodiment. FIG. 17 is an enlarged view illustrating a configuration of the slide member 240 illustrated in FIG. 16.

In the third illustrative embodiment, the slide member 240 having a cuneal leading edge and a sloped surface 240*a* is further provided between the carriage 23 and the main guide member 21. The sloped surface 240*a* of the slide member 240 contacts the outer circumferential surface of the main guide member 21, and the slide member 240 is biased against the main guide member 21 by a biasing member 241 fixed between the slide member 240 and a component of the carriage 23. The slide member 240 is disposed near each of the bearings 231A and 231B in the main scanning direction.

It is necessary to bias the slide member 240 with a force larger than the run-on force that causes the bearings 231 to run onto the main guide member 21. Use of a plate spring or the like for biasing the slide member 240 increases the slide load between the carriage 23 and the main guide member 21. Therefore, the cuneal sliding member 240 having the sloped surface 240*a* is used to prevent an increase in the slide load between the carriage 23 and the main guide member 21. Further, the biasing member 241 biases the slide member 240 with a biasing force not less than a horizontal component force F1 sin θ4 of the force F1, which is applied to the biasing member 241 during acceleration and deceleration of the carriage 23, so as to prevent the bearings 231 from running on the main guide member 21.

Figure 18:
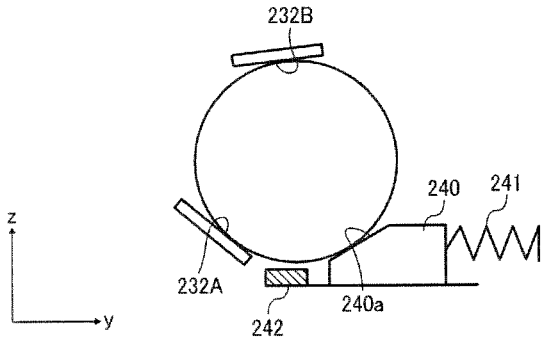
FIG. 18 is a schematic view illustrating a configuration of main components in an image forming apparatus according to a fourth illustrative embodiment.

A description is now given of a fourth illustrative embodiment of the present invention with reference to FIG. 18. FIG. 18 is a schematic view illustrating a configuration of main components in the image forming apparatus 100 according to the fourth illustrative embodiment.

In the fourth illustrative embodiment, in addition to the configuration according to the third illustrative embodiment described above, a restriction member 242 is further provided to restrict movement of the slide member 240 in a direction of sliding of the slide member 240.

Accordingly, the slide member 240 is prevented from digging between the carriage 23 and the main guide member 21. As a result, the slide load between the carriage 23 and the main guide member 21 is reduced to achieve smooth scanning of the carriage 23.

Figure 19:
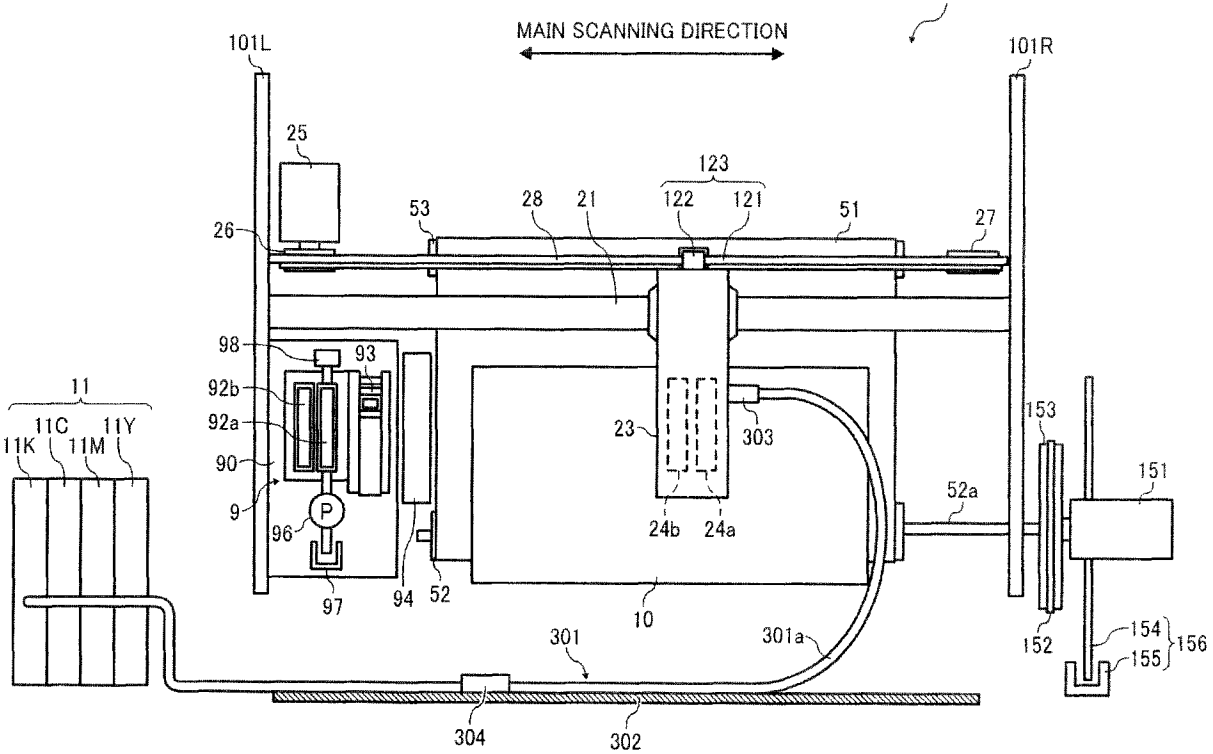
FIG. 19 is a schematic view illustrating a configuration of an image forming apparatus according to a fifth illustrative embodiment.

A description is now given of a fifth illustrative embodiment of the present invention with reference to FIG. 19. FIG. 19 is a schematic view illustrating an example of a configuration of the image forming apparatus 100 according to the fifth illustrative embodiment.

The image forming apparatus 100 according to the fifth illustrative embodiment further includes the supply tube 301, one end of which is connected to main tanks 11K, 11C, 11M, and 11Y (hereinafter collectively referred to as main tanks 11) each storing ink of the specified color, that is, black (K), cyan (C), magenta (M), or yellow (Y). The supply tube 301 is disposed in a bottom portion of the image forming apparatus 100 in the main scanning direction along a tube guide member 302 provided to the main body of the image forming apparatus 100. The supply tube 301 has a curved part 301*a* which is bent vertically upward in a U-shape so that the other end of the supply tube 301 is fixed to a first mount 303 provided to the carriage 23. Thus, the supply tube 301 is connected to the head tank 29 installed on the carriage 23. The tube guide member 302 has a second mount 304 to which the supply tube 301 is fixed.

Figure 20:
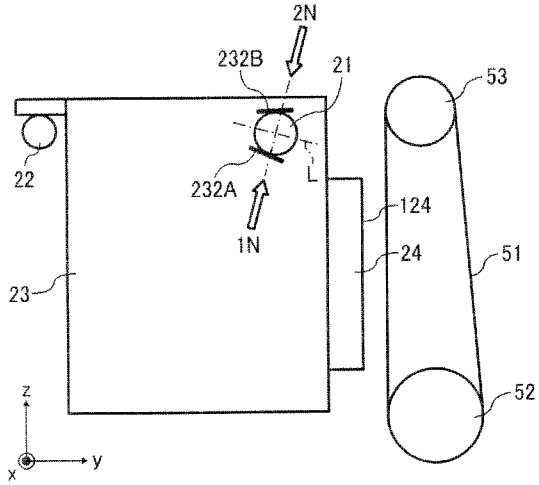
FIG. 20 is a side view illustrating a relation between the insertion angle of each of the sloped sides in the bearing and a direction of restorative force of a supply tube provided to the image forming apparatus according to the fifth illustrative embodiment.

A relation between the angles of the sloped sides 232A and 232B described in the foregoing illustrative embodiments and a direction of a restorative force of the supply tube 301 is described in detail below with reference to FIG. 20.

As described above, the supply tube 301 is bent in a U-shape between the second mount 304 provided to the image forming apparatus 100 and the first mount 303 provided to the carriage 23. Because the supply tube 301 has self-restoring property, restorative force is generated in the supply tube 301 when the supply tube 301 is bent. Application of the restorative force of the supply tube 301 to the carriage 23 disturbs scanning movement of the carriage 23, thereby degrading accuracy in the landing positions of the ink droplets on the sheet 10.

Therefore, it is necessary to set a direction of the restorative force of the supply tube 301 and a position and shape of the first mount 303 provided to the carriage 23 so as not to degrade accuracy in the landing positions of the ink droplets even when the restorative force of the supply tube 301 is applied to the carriage 23.

In the horizontal ejection method in which the nozzle surfaces 124 of the recording heads 24 are vertically disposed, the insertion angle θ2 of each of the bearings 231 is set so as to prevent occurrence of pitching in the carriage 23 as described previously. Consequently, when the supply tube 301 is disposed along the horizontal direction, the restorative force of the supply tube 301 is applied to the bearings 231, thereby floating the sloped sides 232A and 232B of each of the bearings 231. In addition, the bearings 231 run onto the main guide member 21, and consequently, the scanning movement of the carriage 23 is disturbed.

In order to achieve stable scanning movement of the carriage 23 without being affected by a restorative force 1N of the supply tube 301, the direction of application of the restorative force of the supply tube 301 is set based on the insertion angle θ2 of the bearings 231.

Specifically, the direction of the restorative force of the supply tube 301 is set by positioning the supply tube 301 so that the restorative force 1N or 2N of the supply tube 301 is applied in a direction perpendicular to the line L that connects the intersections P1 of the tangent lines L1 and L2 and the axis P2 of the main guide member 21. As a result, the restorative force of the supply tube 301 is applied in a direction in which running of the bearings 231 on the main guide member 21 can be prevented the most. Thus, an impact of the supply tube 301 against the scanning movement of the carriage 23 can be reduced the most.

Figure 21:
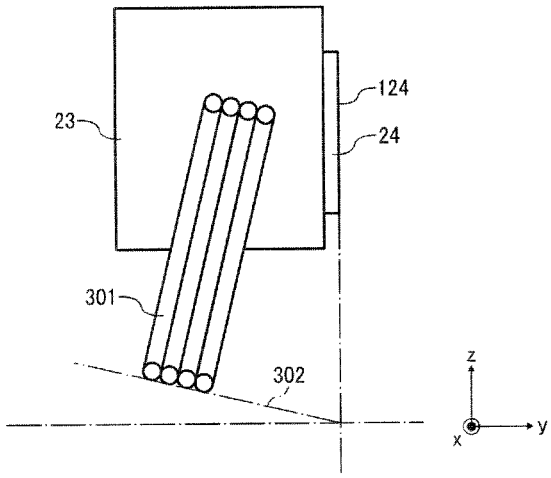
FIG. 21 is a schematic view illustrating an example of disposition of the supply tube.

However, although the above-described disposition of the supply tube 301 reduces the impact of the restorative force of the supply tube 301, the supply tube 301 extends vertically upward from the bottom portion of the image forming apparatus 100 at a slant as illustrated in FIG. 21. As a result, when a group of multiple supply tubes 301 is used, all the supply tubes 301 are disposed vertically at a slant, thereby complicating disposition of the supply tubes 301 and adversely affecting the scanning movement of the carriage 23.

Figure 22:
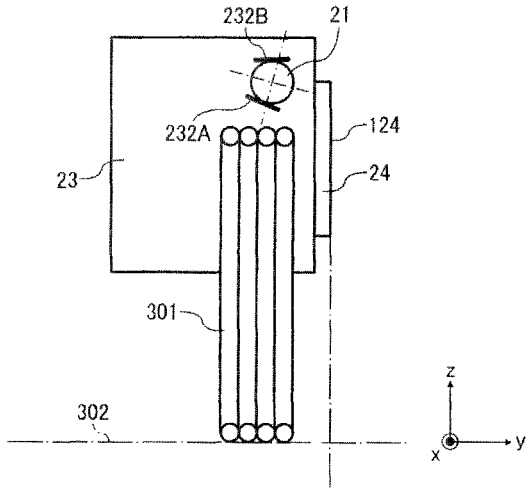
FIG. 22 is a schematic view illustrating a direction of disposition of the supply tube.

Therefore, in the fifth illustrative embodiment, the supply tube 301 has the curved portion 301*a*, which is bent from the bottom portion of the image forming apparatus 100 along the direction of sheet feed, that is, the vertical direction, while the insertion angle θ2 of the bearings 231 is set so as to prevent occurrence of pitching in the carriage 23 as illustrated in FIG. 22. Accordingly, the impact of the restorative force of the supply tube 301 against the scanning movement of the carriage 23 is reduced.

Figure 23:
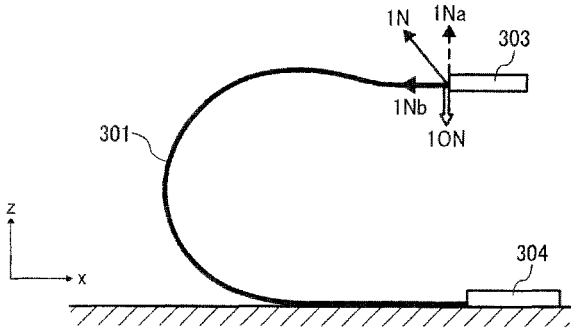
FIG. 23 is a schematic view illustrating relative positions of a mount provided to the carriage and a mount provided to the image forming apparatus.

A description is now given of relative positions of the first mount 303 provided to the carriage 23 and the second mount 304 provided to the image forming apparatus 100 with reference to FIG. 23. FIG. 23 is a schematic view illustrating the relative positions of the mounts 303 and 304.

When the supply tube 301 is bent vertically upward as described above, the mounts 303 and 304 are provided at different positions in the vertical direction. Specifically, the first mount 303 is provided above the second mount 304 in the vertical direction so that a vertical component 1Na of the restorative force 1N of the supply tube 301 and a weight 10N of the supply tube 301 compensate each other. Accordingly, a force applied to the first mount 303 can be reduced.

Figure 24:
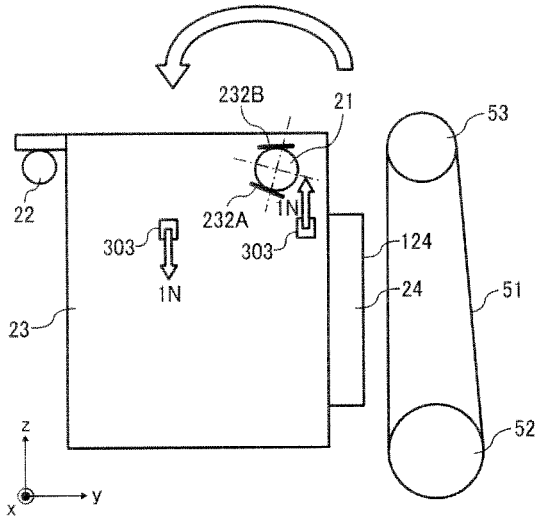
FIG. 24 is a schematic view illustrating a position of the mount that presses the carriage against a main guide member using restorative force of the supply tube.

A position of the first mount 303 that presses the carriage 23 against the main guide member 21 using the restorative force of the supply tube 301 is described in detail below with reference to FIG. 24.

When the restorative force 1N of the supply tube 301 acts on the carriage 23 in the vertically upward direction, the first mount 303 is disposed on the opposite side from the sub-guide member 22 relative to a vertical line passing through the axis of the main guide member 21. As a result, a force that presses the carriage 23 against the sub-guide member 22 is generated by a torque from the main guide member 21. The force that presses the carriage 23 against the sub-guide member 22 can prevent occurrence of rolling in the carriage 23.

By contrast, when the restorative force 1N of the supply tube 301 acts on the carriage 23 in the vertically downward direction, the first mount 303 is disposed on the same side as the sub-guide member 22 relative to the vertical line passing through the axis of the main guide member 21. As a result, the force that presses the carriage 23 against the sub-guide member 22 is generated by the torque from the main guide member 21. The force that presses the carriage 23 against the sub-guide member 22 can prevent occurrence of rolling in the carriage 23.

When it is difficult to dispose the first mount 303 as described above, alternatively, the first mount 303 may be disposed such that the restorative force 1N of the supply tube 301 acts on a line that connects the first mount 303 and the axis of the main guide member 21. As a result, the torque from the main guide member 21 becomes zero, thereby preventing the carriage 23 from floating from the sub-guide member 22.

Figure 25:
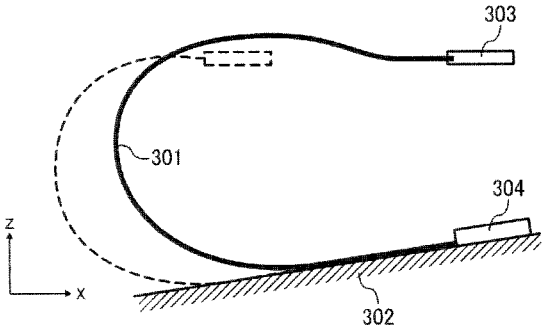
FIG. 25 is a schematic view illustrating an example of a configuration of a tube guide member provided to the image forming apparatus.

A description is now given of the tube guide member 302 provided to the image forming apparatus 100 with reference to FIG. 25.

The curved supply tube 301 may bulge in a direction of the second mount 304 due to the scanning movement of the carriage 23. Consequently, the supply tube 301 may contact other components and be deformed, thereby possibly disturbing the scanning movement of the carriage 23. In order to prevent deformation of the supply tube 301, the curved supply tube 301 bent in a U-shape is disposed along the tube guide member 302.

However, differing from a case in which the supply tube 301 is bent horizontally, when the supply tube 301 is bent vertically as described above, in addition to the swelling of the supply tube 301 due to the scanning movement of the carriage 23, inclination of the supply tube 301 toward the second mount 304 due to the weight of the supply tube 301 also increases a reactive force applied to the supply tube 301 from the tube guide member 302. As a result, when the supply tube 301 is disposed parallel to the main scanning direction of the carriage 23 in a manner similar to the case in which the supply tube 301 is disposed horizontally, a change in load of the supply tube 301 caused by the position of the carriage 23 in the main scanning direction is increased.

Therefore, the tube guide member 302 is disposed at an angle to the main scanning direction so as to reduce a change in the restorative force of the supply tube 301 caused by the position of the carriage 23 during scanning of the carriage 23.

The foregoing illustrative embodiments are also applicable to a configuration in which the sheet 10 is conveyed in a direction slanted from the vertical direction and ink droplets are ejected in a direction slanted from the horizontal direction.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

What is claimed is:

1. An image forming apparatus comprising:

a carriage movable in a main scanning direction and including a recording head having a nozzle surface in which nozzles to eject liquid droplets in a horizontal direction or a direction slanted from the horizontal direction are formed, the nozzle surface being disposed in a vertical direction or a direction slanted from the vertical direction;

a guide shaft to guide the carriage in the main scanning direction; and a plurality of bearings provided to the carriage, each of the plurality of bearings having two sloped sides slidably and tangentially contacting an outer circumferential surface of the guide shaft at respective contact points, wherein, in a plane perpendicular to an axis of the guide shaft, the two sloped sides of each of the plurality of bearings are disposed such that a line passing through both the axis of the guide shaft and an intersection of two tangent lines from the contact points on the outer circumferential surface of the guide shaft at which the two sloped sides contact the outer circumferential surface of the guide shaft diagonally intersects a line extending along a plane of the nozzle surface, and wherein an angle that the line passing through both the axis of the guide shaft and the intersection of the two tangent lines forms with a vertical line ranges from 60 degrees to 90 degrees.

2. The image forming apparatus according to claim 1, further comprising:

a slide member that slidably contacts the guide shaft; and a biasing member that biases the slide member toward the guide shaft.

3. The image forming apparatus according to claim 1, further comprising:

a head tank installed in the carriage to supply liquid to the recording head;

a main tank detachably attachable to the image forming apparatus to store the liquid; and a supply tube disposed below the carriage and extending in the main scanning direction to connect the main tank and the head tank, comprising a curved portion curved from a bottom of the image forming apparatus along a direction of conveyance of a recording medium onto which an image is formed by the recording head so as to be fixed to the carriage.

4. The image forming apparatus according to claim 2, wherein the slide member has a sloped surface that contacts the guide shaft.

5. The image forming apparatus according to claim 3, further comprising a tube guide member disposed in the bottom of the image forming apparatus to guide the supply tube, wherein the tube guide member is disposed at an angle to the main scanning direction.

6. The image forming apparatus according to claim 4, wherein the slide member has a cuneal shape.

7. An image forming apparatus comprising:

a carriage movable in a main scanning direction and including a recording head having a nozzle surface in which nozzles to eject liquid droplets in a horizontal direction or a direction slanted from the horizontal direction are formed, the nozzle surface being disposed in a vertical direction or a direction slanted from the vertical direction;

a guide shaft to guide the carriage in the main scanning direction;

a plurality of bearings provided to the carriage, each of the plurality of bearings having two sloped sides slidably and tangentially contacting an outer circumferential surface of the guide shaft at respective contact points, a transmission part provided to the carriage, to which a drive force is transmitted from a drive source, wherein, in a plane perpendicular to an axis of the guide shaft, the two sloped sides of each of the plurality of bearings are disposed such that a line passing through both the axis of the guide shaft and an intersection of two tangent lines from the contact points on the outer circumferential surface of the guide shaft at which the two sloped sides contact the outer circumferential surface of the guide shaft diagonally intersects a line extending along a plane of the nozzle surface, and wherein, in a plane perpendicular to the main scanning direction, the transmission part is disposed between the center of gravity of the carriage and the guide shaft, and the intersection of the two tangent lines is positioned on the same side as the center of gravity of the carriage.

8. The image forming apparatus according to claim 7, further comprising:

a slide member that slidably contacts the guide shaft; and a biasing member that biases the slide member toward the guide shaft.

9. The image forming apparatus according to claim 7, further comprising:

a head tank installed in the carriage to supply liquid to the recording head;

a main tank detachably attachable to the image forming apparatus to store the liquid; and a supply tube disposed below the carriage and extending in the main scanning direction to connect the main tank and the head tank, comprising a curved portion curved from a bottom of the image forming apparatus along a direction of conveyance of a recording medium onto which an image is formed by the recording head so as to be fixed to the carriage.

10. The image forming apparatus according to claim 8, wherein the slide member has a sloped surface that contacts the guide shaft.

11. The image forming apparatus according to claim 9, further comprising a tube guide member disposed in the bottom of the image forming apparatus to guide the supply tube, wherein the tube guide member is disposed at an angle to the main scanning direction.

12. The image forming apparatus according to claim 10, wherein the slide member has a cuneal shape.

13. An image forming apparatus comprising:

a carriage movable in a main scanning direction and including a recording head having a nozzle surface in which nozzles to eject liquid droplets in a horizontal direction or a direction slanted from the horizontal direction are formed, the nozzle surface being disposed in a vertical direction or a direction slanted from the vertical direction;

a guide shaft to guide the carriage in the main scanning direction;

a plurality of bearings provided to the carriage, each of the plurality of bearings having two sloped sides slidably and tangentially contacting an outer circumferential surface of the guide shaft at respective contact points, a transmission part provided to the carriage, to which a drive force is transmitted from a drive source, wherein, in a plane perpendicular to an axis of the guide shaft the two sloped sides of each of the plurality of bearings are disposed such that a line passing through both the axis of the guide shaft and an intersection of two tangent lines from the contact points on the outer circumferential surface of the guide shaft at which the two sloped sides contact the outer circumferential surface of the guide shaft diagonally intersects a line extending along a plane of the nozzle surface, and wherein, in a plane perpendicular to the main scanning direction, the transmission part is disposed on an opposite side of the guide shaft from the center of gravity of the carriage, and the intersection of the two tangent lines is positioned on an opposite side of the center of gravity of the carriage.

14. The image forming apparatus according to claim 13, further comprising:

a slide member that slidably contacts the guide shaft; and a biasing member that biases the slide member toward the guide shaft.

15. The image forming apparatus according to claim 13, further comprising:

a head tank installed in the carriage to supply liquid to the recording head;

a main tank detachably attachable to the image forming apparatus to store the liquid; and a supply tube disposed below the carriage and extending in the main scanning direction to connect the main tank and the head tank, comprising a curved portion curved from a bottom of the image forming apparatus along a direction of conveyance of a recording medium onto which an image is formed by the recording head so as to be fixed to the carriage.

16. The image forming apparatus according to claim 14, wherein the slide member has a sloped surface that contacts the guide shaft.

17. The image forming apparatus according to claim 15, further comprising a tube guide member disposed in the bottom of the image forming apparatus to guide the supply tube, wherein the tube guide member is disposed at an angle to the main scanning direction.

18. The image forming apparatus according to claim 16, wherein the slide member has a cuneal shape.

* * * * *